US007060162B2

(12) United States Patent
Baker

(10) Patent No.: US 7,060,162 B2
(45) Date of Patent: Jun. 13, 2006

(54) CHIP BIN

(75) Inventor: Jack T. Baker, P.O. Box 116, Greenwich, NY (US) 12834

(73) Assignees: Jack T. Baker, Greenwich, NY (US); Myles M. Miller, Glens Falls, NY (US)

( * ) Notice: Subject to any disclaimer, the term of this patent is extended or adjusted under 35 U.S.C. 154(b) by 0 days.

(21) Appl. No.: 10/652,817

(22) Filed: Aug. 29, 2003

(65) Prior Publication Data

US 2005/0045298 A1 Mar. 3, 2005

(51) Int. Cl.
*D21C 7/00* (2006.01)
*D21F 1/00* (2006.01)

(52) U.S. Cl. ..... 162/237; 162/232; 162/238; 162/246; 162/17; 162/52; 162/29; 222/146.4

(58) Field of Classification Search ..... 162/237, 162/232, 238, 246, 17, 52, 29; 222/146.4
See application file for complete search history.

(56) References Cited

U.S. PATENT DOCUMENTS 3,661,328 A * 5/1972 Leask ..... 241/18
4,172,539 A 10/1979 Botkin ..... 222/195
5,413,677 A 5/1995 Collins ..... 162/42
5,454,490 A * 10/1995 Johanson ..... 222/146.4
5,476,572 A 12/1995 Prough ..... 162/246
5,500,083 A 3/1996 Johanson ..... 162/17
5,547,546 A * 8/1996 Prough et al. ..... 162/238
5,622,598 A 4/1997 Prough ..... 162/52
5,736,006 A 4/1998 Prough ..... 162/52
6,497,791 B1 12/2002 Baker ..... 162/246

OTHER PUBLICATIONS

Installation in a flour silo on Long Island, NY, date unknown, as further described in the accompanying paper.

* cited by examiner

*Primary Examiner*—Mark Halpern
(74) *Attorney, Agent, or Firm*—Drinker Biddle&Reath LLP

(57) ABSTRACT

A chip bin for a digester has an upper part through which chips fall freely from an inlet and a lower part within which the chips remain until they are fed to a digester. Steam orifices strike falling chips with steam and disperses the chips over the interior of the chip bin. Further steam heats the chips and drives out non-condensable gas. The lower part of the chip bin is conical. Steam jets aimed down the conical walls propel the chips to an outlet at the bottom and prevent bridging.

17 Claims, 5 Drawing Sheets

FIG. 3
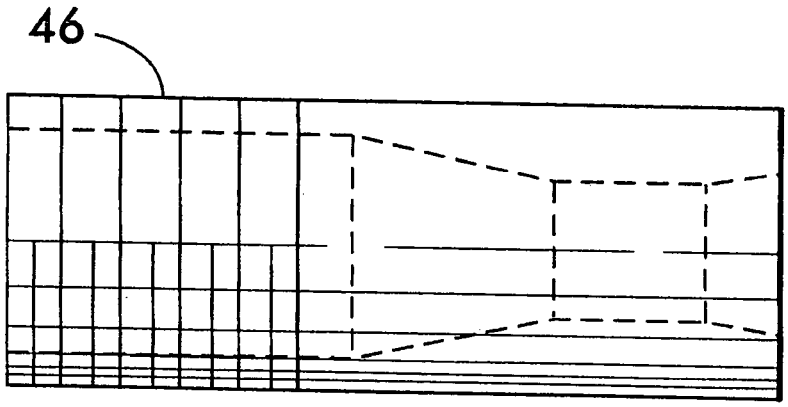
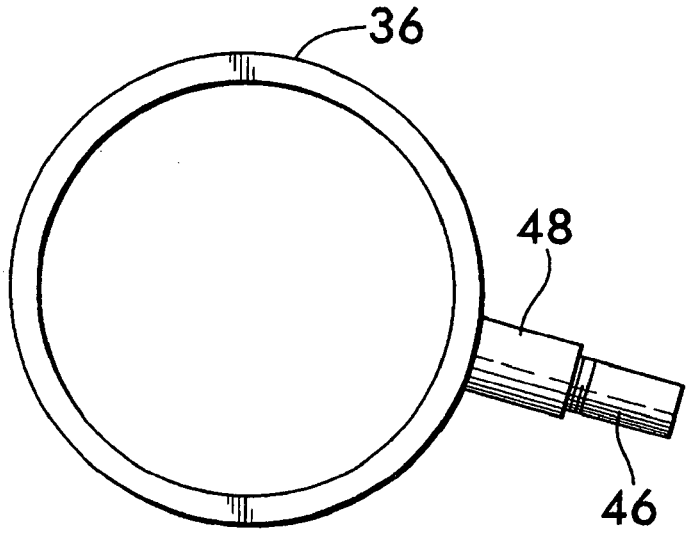
FIG. 4

FIG.5
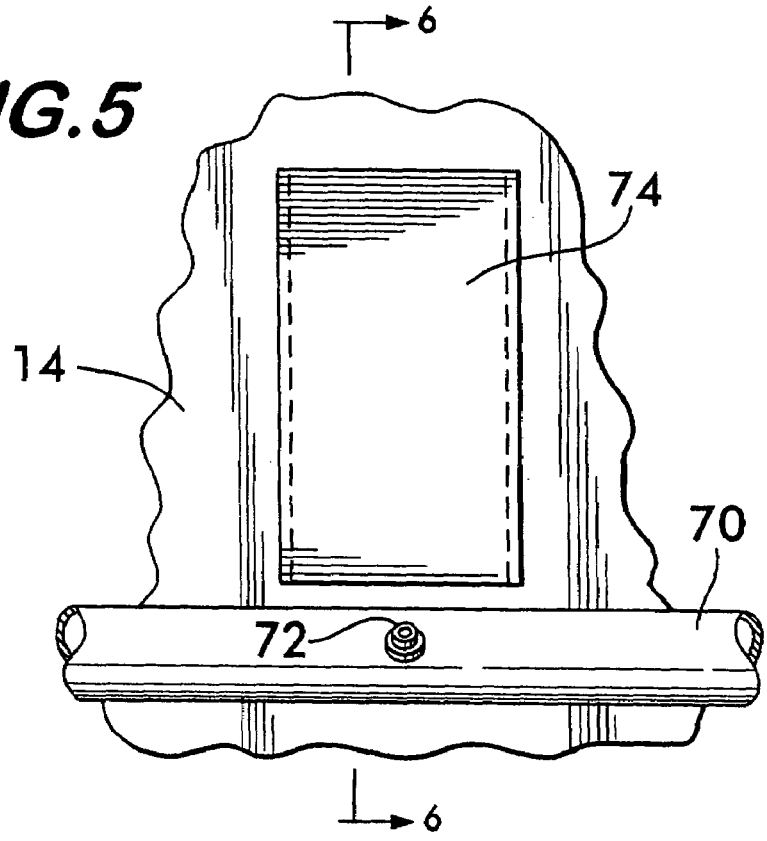
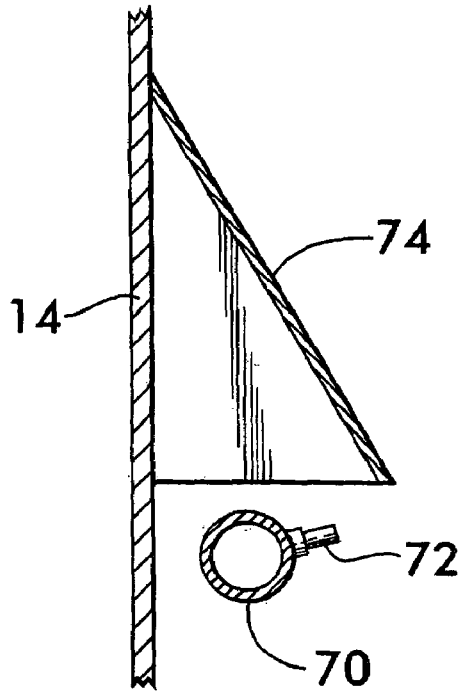
FIG.6

FIG. 7
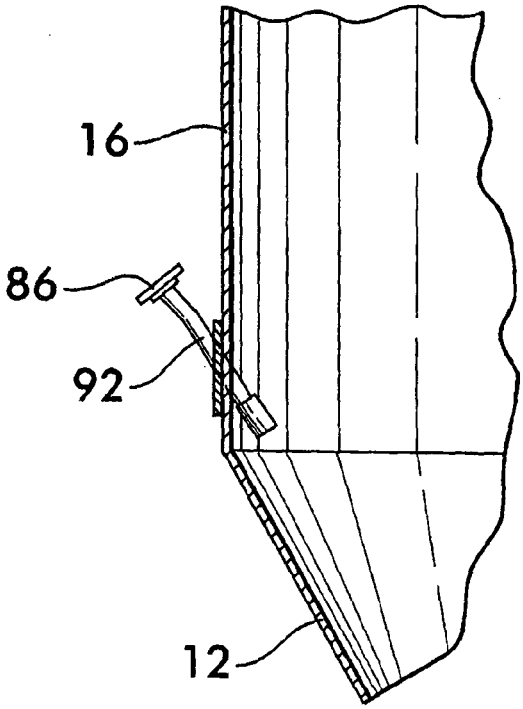
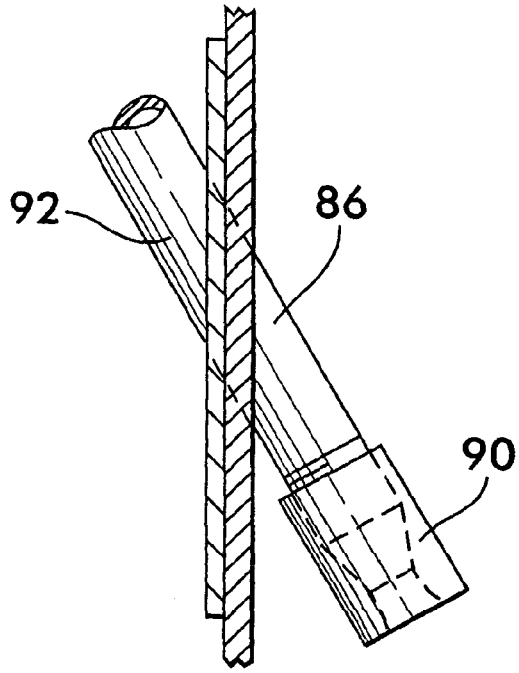
FIG. 8
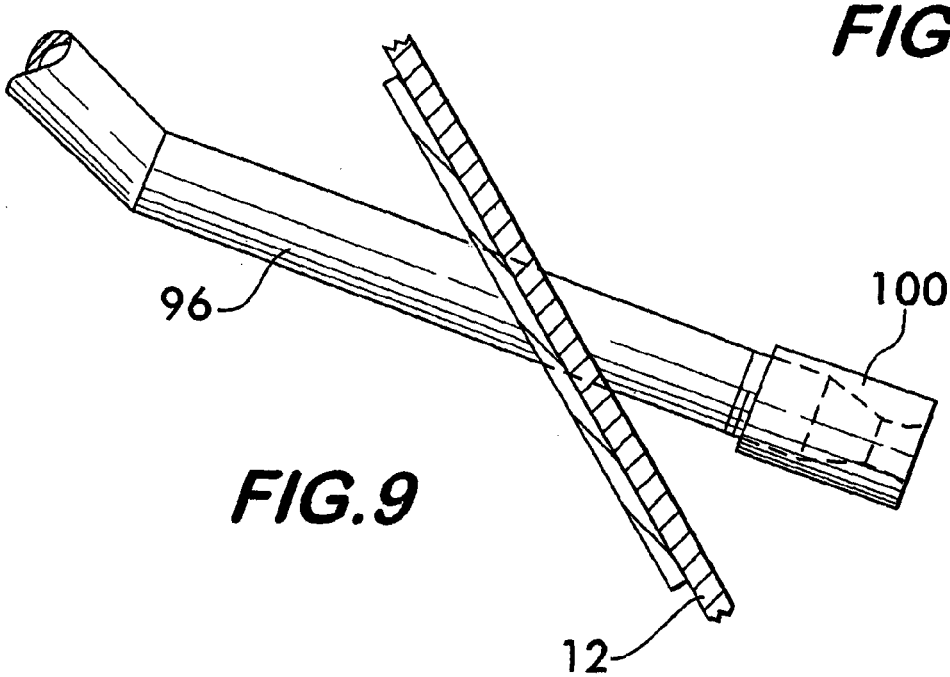
FIG. 9

CHIP BIN

FIELD OF THE INVENTION

The invention relates to chip bins, and in particular to a chip bin that both stores and pre-treats wood chips to be fed into a digester for conversion into pulp.

BACKGROUND OF THE INVENTION

A conventional chip bin serves primarily to ensure a steady flow of wood chips to the subsequent steaming and digesting stages in pulp production. Chips are brought in from a wood chip yard by a conveyor, and fed into the top of the chip bin. The chips are then transferred out of the bottom of the chip bin using a feeder valve or chip meter, which produces a constant flow of chips, into a steaming vessel. In the steaming vessel, the chips are heated with steam at superatmospheric pressure, so that non-condensable gases are removed from the chips and the chips become impregnated with liquid, primarily condensed steam. The chips are then discharged from the steaming vessel into a chip chute where liquor is introduced, then via a high-pressure feeder into a digester where they are converted into pulp.

U.S. Pat. No. 5,500,083 to Johanson describes a chip bin in which low-pressure steam is introduced into the chip bin to start the steaming process before the chips are transferred to a conventional steaming vessel.

U.S. Pat. No. 5,736,006 (Prough) describes a process using Johanson's chip bin. Prough proposes heating the chips in the chip bin to a temperature of 110° C. or less, preferably to 105° C. or less in steam at 3 psig (20 kPa) or less, and suggests that it is then possible to dispense with a separate steaming stage.

Neither Johanson nor Prough describes the steaming process in detail, and the present applicant has found that the system implied by Johanson's construction, with steam introduced at low pressure through inlets in the outer wall of the chip bin, is not very effective.

BRIEF DESCRIPTION OF THE INVENTION

It is an object of the invention to provide an apparatus in which the chips within the chip bin are effectively treated with steam, so as to expel non-condensable gases and impregnate the pores of the chips with liquid, making them ready for pulping in a digester.

In one aspect of the invention, there is provided a chip bin with a manifold having steam orifices that direct steam at high pressure and velocity into the incoming mass of chips. The impact of this steam breaks up the incoming mass into its individual chips, exposing the individual chips within the mass to the steam, greatly improving the heat transfer and expulsion of non-condensable gases.

In another aspect of the invention, the chip bin is provided with upwardly-angled steam orifices. The high-velocity steam emitted from these orifices both increases the temperature of the chips and, by transferring an upward component of momentum, delays the falling of the chips and increases their dwell time within the associated zone of the chip bin. The steam orifices may be angled tangentially, so as to cause a turbulent swirling motion and improve mixing of the chips with the steam.

The chip bin may be provided with one or more conical baffles to guide the falling chips away from the wall of the bin, so that the chips are correctly placed in front of the steam orifices. In another aspect of the invention, the conical baffles may serve as collectors for non-condensable gases. The undersides of the baffles are preferably in communication with an exhaust system for gas removal.

The chip bin may have two or more treatment zones, each with steam orifices in accordance with the invention.

In another aspect of the invention, a tapered, preferably conical, region at the bottom of the bin guides the chips to an outlet. To prevent bridging of the chips in the tapered region, steam nozzles are provided to send jets of steam downward along the conical surface. These jets of steam form a fast-moving vapor barrier that greatly reduces any tendency of the chips to bridge across the outlet and stop flowing.

In another aspect of the invention, the bottom region of the chip bin is allowed to fill with chips to a certain level, providing a reservoir to supply the digester if there is any fluctuation in the rate of supply of chips into the chip bin. Cooking liquor is introduced into this region, so that the chips can start to absorb the liquor and begin to be digested even before entering the digester itself. This liquor also creates with the chips a slurry that may be easier to transport than the steamed but unslurried chips.

In another aspect of the invention, the temperature of the chips in the bottom region of the chip bin is monitored, and the flow of steam higher up is regulated to avoid overheating of the chips.

BRIEF DESCRIPTION OF THE DRAWINGS

For the purpose of illustrating the invention, there are shown in the drawings forms of the invention which are presently preferred; it being understood, however, that this invention is not limited to the precise arrangements and instrumentalities shown. In the drawings:

FIG. 3 is an axial section through an orifice of a steam manifold of the chip bin shown in FIG. 2.

FIG. 4 is a section through part of a steam manifold including the orifice shown in FIG. 3.

FIG. 5 is a front elevation view of an orifice cover and part of a steam manifold including a steam orifice.

FIG. 6 is a side view of the orifice cover and steam orifice shown in FIG. 5.

FIG. 7 is an enlarged detail of FIG. 2, showing a steam inlet nozzle.

FIG. 8 is a further enlarged view of part of the steam inlet nozzle shown in FIG. 7.

FIG. 9 is an enlarged detail of another steam inlet nozzle of the chip bin shown in FIG. 2.

DETAILED DESCRIPTION OF THE DRAWINGS

Figure 1:
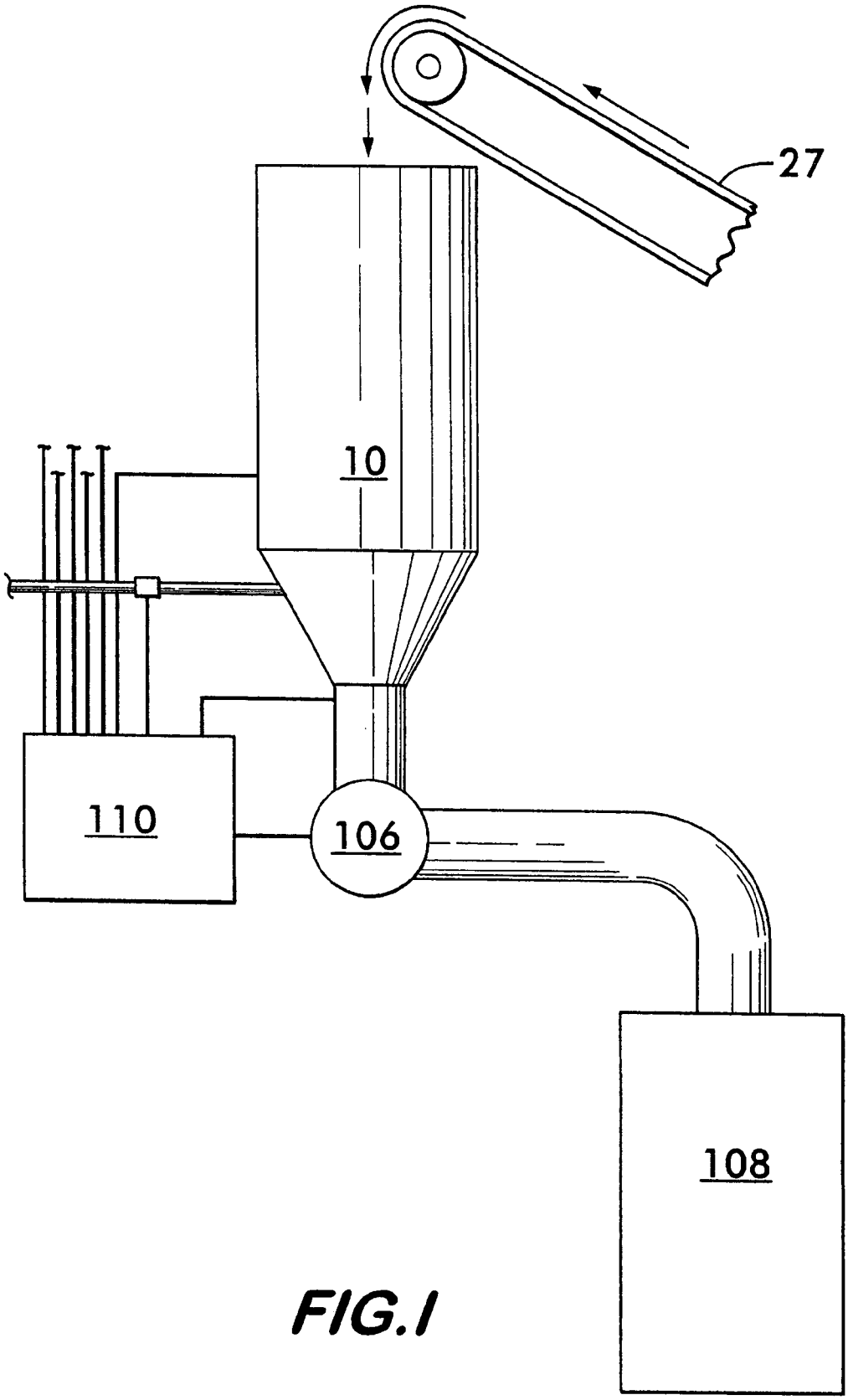
FIG. 1 is a diagram of a wood chip pulping plant incorporating a chip bin according to the invention.
Figure 2:
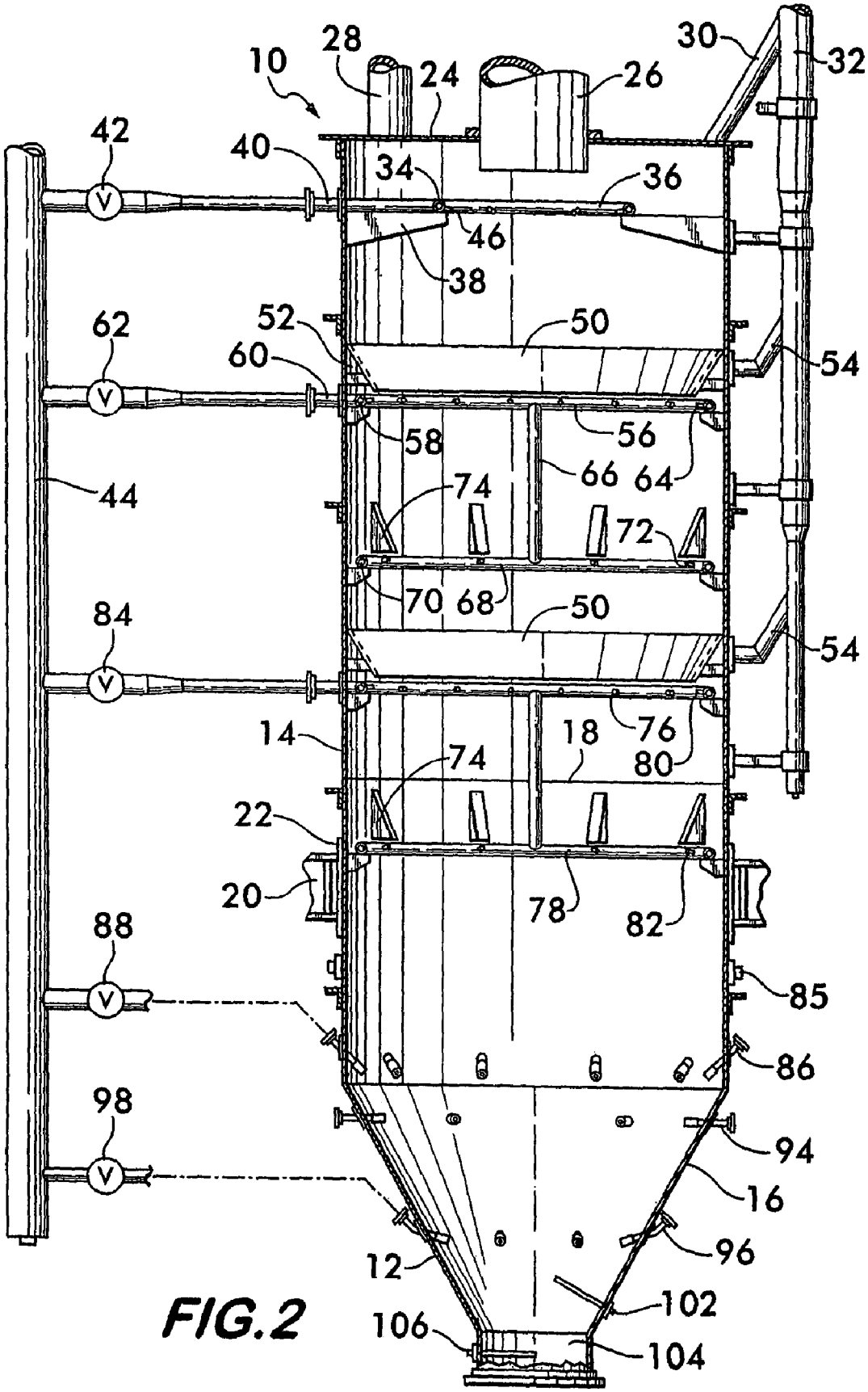
FIG. 2 is a side elevation view, partly in axial section and partly schematic, of one form of chip bin according to the invention.

Referring to the drawings, and initially to FIGS. 1 and 2, one form of chip bin in accordance with the invention, indicated generally by the reference numeral 10, is cylindrical, with a conically tapered bottom region 12, typically having a cone half angle of 30°. The bin may, for example, be approximately 12' (3.66 m) in diameter and 38' (11.6 m) high. It is preferably formed from SA 240-304L steel sheet, ¼" (6.35 mm) thick in the upper part 14, and ⅜" (9.5 mm) thick in the lower part 16, including the cone 12. The two parts 14 and 16 are joined at a seam 18 just above a support frame 20, which is joined to the wall 14 of the chip bin 10 through a reinforcing belt or pad 22.

The top of the chip bin 10 is closed with a cover 24, through the center of which passes a wood chip inlet nozzle 26, typically in the form of a 40" (1 meter) diameter pipe. Wood chips are supplied to the wood chip inlet nozzle 26 by a conveyor 27 from a chip yard or other source or stock of wood chips (not shown). The wood chip inlet nozzle 26 terminates in an open end about 1' (30 cm) below the cover 24. A pipe 28, leading to a pressure-vacuum assembly (not shown) also passes through the cover 24. The pressure-vacuum assembly serves to maintain the pressure within the chip bin 10 at substantially zero gauge, and may be of conventional design. An exhaust pipe 30 leads through the cover 24 to an exhaust manifold 32, through which non-condensable gases and surplus steam are removed. A manway for access to the interior of the chip bin 10 may also be provided in the cover 24.

A first steam manifold 34 is preferably positioned approximately 1' (30 cm) below the outlet of the wood chip inlet nozzle 26. The first steam manifold 34 comprises a circular pipe 36, typically of 71¼" (1.8 m) centerline diameter, positioned coaxially with the chip bin 10. The circular pipe 36 is supported on six brackets 38 projecting from the wall 14 of the chip bin 10. The circular pipe 36 is supplied through a pipe 40 and a motorized valve 42 from a steam main 44.

Referring now also to FIG. 3, the circular pipe 36 of the first steam manifold 34 carries twelve steam orifices 46, each positioned to point radially inward, and typically angled 15° down and tangentially 15° counterclockwise when viewed from above. The centerlines of the orifices 46 intersect the centerline of the circular pipe 36. Typically, each orifice 46 has an internal diameter of 0.742" (18.8 mm) that is constant for a length of 1.25" (31.75 mm), then narrows over a length of 0.625" (15.9 mm) to a throat diameter of 0.469" (11.9 mm). This throat diameter remains constant, typically for a length of 0.5" (12.7 mm), then widens, typically at a half angle of 5° over a length of 0.25" (6.35 mm), to the outlet end. As shown in FIG. 4, each orifice 46 is screwed into an internally threaded stub pipe 48 projecting from the circular pipe 36.

Below the first steam manifold 34 is a conical baffle 50 that projects from the wall 14, typically at an angle of 30° to the vertical. The lower rim of the baffle 50 is typically about 11" (280 mm) from the wall 14. The top of the baffle 50 is welded to the wall 14 around substantially its entire perimeter, forming a space 52 closed at the top, which is connected by pipes 54 to the exhaust manifold 32. Thus, any non-condensable gas rising from the lower part of the chip bin 10 readily becomes trapped in the space 52 under the baffle 50 and is drawn off to the exhaust manifold 32.

Immediately below the baffle 50, and typically 6 feet (1.8 m) below the first steam manifold 34, is a second steam manifold 56, comprising a circular pipe 58, typically of centerline diameter of 134¼" (3.4 m), which is supplied with steam from the steam main 44 through a pipe 60 and a motorized valve 62. The second steam manifold 56 is provided with sixteen steam orifices 64, which are similar to the steam orifices 46 of the first steam manifold 34 except that the throat diameter is typically only 0.438" (11.1 mm). The steam orifices 64 of the second steam manifold 56 are typically angled 3° upwards and 15° tangentially counter-clockwise.

Referring now also to FIGS. 4, 5 and 6, a pipe 66 leads down from the circular pipe 58 of the second steam manifold 56 to a third steam manifold 68, which comprises a circular pipe 70 similar to the circular pipe 58. The circular pipe 70 has eight orifices 72, which are similar to the orifices 46 shown in FIG. 3, except that the outermost part of the orifice flares outwards at a half angle of typically 1° instead of 5°. The third steam manifold 68 is oriented so that each steam orifice 72 is positioned below a point midway between two orifices 64 of the second steam manifold 56. The orifices 72 of the third steam manifold 68 are angled upwards, typically at 15° with no tangential angle.

Each orifice 72 of the third steam manifold 68 is protected against falling chips by an orifice cover 74 consisting essentially of a metal plate fixed to the wall 14 of the chip bin 10 at its top edge and angled down and away from the wall. The orifice covers 74, like the baffle 50, are typically angled at 30° to the vertical, and are typically 11" (280 mm) from the wall at their bottom edges. The bottom edges of the orifice covers 74 are typically about 4" (100 mm) above the centerline of the circular pipe 70, so that the upwardly-angled jets of steam from the orifices 72 can pass below the orifice covers 74. Each orifice cover 74 is typically 1' (300 mm) wide, and is centered over its respective orifice 72.

A fourth steam manifold 76 and a fifth steam manifold 78 are identical to the second and third steam manifolds 56 and 68, except that the steam orifices 80 of the fourth steam manifold 76, like the steam orifices 82 of the fifth steam manifold 78, typically have a throat diameter of 0.469" (11.9 mm). The fourth steam manifold 76, like the second steam manifold 56, is protected by a baffle 50, which has an exhaust pipe 54 leading to the exhaust manifold 32. The fifth steam manifold 78, like the third steam manifold 68, is protected by orifice covers 74. A motorized valve 84 supplies the fourth steam manifold 76 and, through a vertical pipe 66, the fifth steam manifold 78, with steam from the steam main 44.

The fifth steam manifold 78 is just above the support frame 20. Just below the support frame 20 is the level to which, in normal use, the chip bin may fill with a mixture of chips and digester cooking liquor. This level is determined by level sensors 85 in the wall 16 of the chip bin 10.

A short distance, typically eight inches (20 cm), above the top of the conical bottom 12 of the chip bin 10 is a ring of twelve steam nozzles 86, which are supplied with steam from the steam main 44 through a motorized valve 88. As shown in FIG. 7, each steam nozzle 86 is aligned parallel to the surface of the conical bottom 12 of the chip bin, typically with no tangential angle, that is to say, at 30° to the vertical. The centerline of the nozzle 86 is typically 4" (10 cm) from the surface of the conical bottom 12. Each steam nozzle 86 has an orifice 90, typically with an internal diameter of 1" (25.4 mm) for a length of 1" (25.4 mm). This part is internally threaded, and is screwed and tack welded onto a stub pipe 92 projecting from the wall 16 of the chip bin 10. The orifice then narrows, typically over a length of 1" (25.4 mm) to a throat 0.75" (19 mm) in diameter and 0.5" (12.7 mm) long. The orifice then widens, typically at a cone half angle of 1° over 0.25" (6.35 mm), to its free end. The free end of the orifice 90 is typically 11½" (292 mm) from the middle of the thickness of the wall 16, measured along the centerline of the nozzle 86.

Six liquor nozzles 94 open into the chip bin 10, typically one foot (30 cm) below the top of the conical bottom 12. Each liquor nozzle 94 is positioned below a point half way between two of the steam nozzles 86, so that the inflow of liquor does not interrupt the downward jets of steam from the nozzles 86. The liquor nozzles 94 are horizontal, with no tangential angle, and their outlets are flush with the wall of the conical bottom 12.

A final ring of eight steam nozzles 96, shown in detail in FIG. 9, is provided in the conical bottom 12, typically 52" (1.32 m) below the top of the conical bottom and 36" (915 mm) above the bottom of the conical part, measured vertically. The steam nozzles 96 are supplied through a motorized valve 98 from the steam main 44. The steam nozzles 96 are angled downward, typically at 20°, with no tangential angle. Each steam nozzle 96 has an orifice 100, typically with a throat 0.75" (19 mm) in diameter and 0.5" (12.7 mm) long, and widens, typically at a half angle of 2° over a length of 0.25" (6.35 mm) to its free end. The steam nozzles 96 project, typically approximately 6" (150 mm) into the chip bin 10.

A flow sensor 102 projects into the chip bin just above the lower end of the conical bottom 12. The bottom 12 opens into a cylindrical outlet 104, in which there is disposed a chip temperature sensor 106.

The outlet 104 is connected to a metering pump 106 or other device for feeding chips from the outlet 104 at a controlled rate. The pump 106 transfers the chips from the chip bin 10 to a digester 108. The pump 108, along with the motorized valves and sensors, may be controlled by a suitably programmed computer or other central control unit 110.

In use, wood chips are fed into the wood chip inlet nozzle 26 from a conveyor (not shown) or other device for delivering the wood chips. The rate of supply may be regulated in response to the level sensor 85. If the level sensor 85 indicates a level of chips and liquor above the sensor, the feeding of chips through the wood chip inlet nozzle 26 may be suspended, or the rate of feeding may be reduced, until the level drops again.

In practice, the wood chips often enter the wood chip inlet nozzle 26 in a mass that does not automatically break up into individual wood chips. If the mass was allowed to fall as a mass through the chip bin 10, it would not readily be penetrated by steam, and its interior would remain dry, with much of its original non-condensable gas content. This would significantly hinder the penetration of the digester cooking liquor, and impair the process of converting the wood chips into pulp.

The steam main 44 supplies steam at 331° F. (166° C.) and 100 psig (690 kPa) to all of the motorized valves supplying the steam manifolds and steam nozzles of the chip bin 10.

Whenever chips are falling through the wood chip inlet nozzle 26, the motorized valve 42 is open, admitting steam from the steam main 44 to the first steam manifold 34. Because of the relative positioning of the outlet of the wood chip inlet nozzle 26 and the orifices 46 of the first steam manifold 34, the entire incoming stream of wood chips is effectively exposed to the jets of steam from the orifices. In particular, the diameter of the circular pipe 36 of the first steam manifold 34 is sized to encircle the incoming stream of wood chips with a sufficient space that the chips do not slip through the gaps between adjacent orifices 46.

The motorized valve 42 is an on/off valve, and when it is on it delivers the full pressure from the steam main 44, typically effectively about 90 psig (620 kPa), to the first steam manifold 34. The orifices 46 typically discharge a total of 9644 lbs/hr (4374 kg/hr) of steam at 1202 ft/s (366 m/s), striking the incoming masses of wood chips, disrupting the masses and distributing the wood chips over the interior of the chip bin 10. The downward angle of the orifices 46 impels the wood chips down into the next zone of the chip bin 10. The tangential angle of the orifices 46 imparts a turbulent swirling motion to the chips.

The chips then fall past the first baffle 50 and the second steam manifold 56. The first baffle 50 guides the chips far enough from the wall that they are properly exposed to the jets of steam from the second steam manifold, and prevents them from falling onto and clogging the orifices 64. The orifices 64 typically discharge a total of 11,147 lbs/hr (5056 kg/hr) of steam when the motorized valve 62 is fully open. The motorized valve 62 is controlled in response to the chip temperature sensor 106, to keep the final temperature of the chips at a desired level. The upward angle of the orifices 64 retards the falling of the wood chips, increasing the time for which the wood chips remain falling, and the tangential angle of the orifices 64 maintains the swirling motion, increasing the efficiency of heat transfer from the steam jets to the chips.

The chips then fall through the third steam manifold 68. The orifices 72 of the third steam manifold 68 typically discharge a total of 6430 lbs/hr (2916 kg/hr) of steam when the motorized valve 62 is fully open. The upward angle of the orifices 72 further reduces the rate of fall of the chips, while assisting the steam to penetrate to the center of the falling chips within the chip bin 10. These orifices ensure turbulent contact between the steam jets and the chips over the whole distance from the edges to the center of the chip bin 10.

The chips then fall through the third and fourth steam manifolds 76 and 78, which repeat the treatment given by the second and third steam manifolds 56 and 68.

As the chips fall through this upper part of the bin 10, the constant tumbling and agitation, and exposure to hot steam at a temperature in excess of 300° F. (150° C.), heats the chips from a typical chip yard temperature of 40° F. (5° C.) to, for example, 203° F. (95° C.). The total heat available for heating the chips is 4,950,000 BTU every 15 minutes. It has been calculated that 4,052,750 BTU are required for 50 tons/hr (45.5 tonnes/hr) of wood chips with an initial moisture content of 50%. The heat causes the non-condensable gases in the chips to expand and increase in pressure. This results in the gases forcing their way out of the chips and escaping. Almost all of the steam condenses onto the chips, giving up further heat in the process. The condensate soaks into the chips, and replaces the gases with water.

The displaced gases, and any surplus steam, rise up the chip bin until they are caught under one of the baffles 50 or the cover 24, and are led off along one of the exhaust pipes 30, 54 to the exhaust manifold 32. The system is preferably designed with a steam supply capacity of 1.25 times the maximum estimated demand. The amount of steam actually used is largely adjusted to the actual load, because the temperature sensor 106 regulates the final chip temperature by regulating the steam supply through the motorized valves 62 and 84. However, the total steam injected into the chip bin 10 typically slightly exceeds the amount of condensate absorbed by the chips or used as liquid in the slurry discharged through the outlet 104. This excess steam is extracted along with the non-condensable gases.

The chips then fall into the lower part of the chip bin 10, where they dwell for approximately 15 minutes before being drawn off through the outlet 104. The rate of flow of the chips out of the outlet 104 is determined by the feeding device 106.

The lower part of the chip bin 10 is substantially filled with chips, low pressure steam vapor, typically at temperatures in excess of 250° F. (125° C.), condensate, and hot cooking liquor. These ingredients form a chip slurry that flows steadily downward through the lower part of the chip bin 10, assisted by the downward jets of steam from the nozzles 86, forming a vapor barrier along the wall of the conical bottom 12 of the chip bin 10. If the chips are flowing normally, the motorized valve 88 is set to 50% open and the motorized valve 98 is closed, to economize on the amount of steam injected into the liquor. If the sensor detects that the flow of chips has dropped below a threshold, the motorized valve 88 is switched to 100% open, and the motorized valve 98 is opened, delivering typically a total of 34,100 lbs/hr (15,500 kg/hr) of steam at 1202 ft/sec (366 m/s) through the nozzles 86 and 96. This is sufficient to disrupt any bridges that may be forming. As soon as normal flow is detected, the valves 88 and 98 are returned to their normal states.

Hot cooking liquor is introduced into the bottom 12 of the chip bin 10 through the liquor nozzles 94. This hot liquor serves to increase the temperature of the chips from the temperature achieved while falling through the five steam manifolds, typically 203° F. (95° C.), to the desired final temperature of 210 to 212° F. (99 to 100° C.). At this temperature, in a chip bin 10 that is kept substantially at ambient pressure, the water within the chips starts to vaporize, expelling any remaining non-condensable gases. The hot liquor also serves to lubricate the cone 12 and to form a slurry with the steamed chips, which may be easier to handle and transfer to the digester 108. Supplying the chips to the digester 108 already heated to around 212° F. (100° C.) and already impregnated with digester cooking liquor also reduces the cooking time in the digester 108, increasing throughput and saving on energy.

By removing gases from the chips, the above process and apparatus cause the chips to be more fully and uniformly impregnated with cooking liquor. This results in chips that more thoroughly absorb the liquor within the digester. The resultant pulp is more uniform, and can provide a better, stronger paper.

The present invention may be embodied in other specific forms without departing from the spirit or essential attributes thereof and, accordingly, reference should be made to the appended claims, rather than to the foregoing specification, as indicating the scope of the invention. For example, although numerical values have been given for both the structure of the chip bin and the process conditions, including steam temperature, pressure, and velocity, it will be understood that those values are purely exemplary. The numerical values may be varied appropriately, for example, for a larger or smaller chip bin, for a greater or lesser throughput of chips, for chips of different species of wood or different initial moisture content or otherwise in different condition, and/or for the production of different qualities of pulp.

Although the invention has been described and illustrated with respect to the exemplary embodiments thereof, it should be understood by those skilled in the art that the foregoing and various other changes, omissions and additions may be made therein and thereto, without parting from the spirit and scope of the present invention. Accordingly, reference should be made to the appended claims, rather than to the foregoing specification, as indicating the scope of the invention.

The invention claimed is:

1. A chip bin having an upper part through which chips are arranged to fall freely from an inlet;

a lower part within which chips are arranged to remain until they are removed by a feeding device downstream;

a level sensor arranged to detect a level of said chips between said upper part and said lower part; and steam orifices above said level sensor arranged to strike chips falling from said inlet with steam.

2. A chip bin according to claim 1, comprising upwardly angled steam orifices arranged to direct steam upward at said chips and thereby to delay the falling of the chips.

3. A chip bin according to claim 2, comprising steam orifices angled tangentially.

4. A chip bin according to claim 1, comprising at least one conical baffle projecting from a wall of said bin to guide the falling chips away from the wall of the bin, and steam orifices disposed below said at least one baffle and arranged to direct steam at chips falling past said baffle in said upper part of said chip bin.

5. A chip bin according to claim 1, comprising at least two treatment zones in said upper part of said chip bin through which said chips fall successively, each with steam orifices arranged to direct steam onto said falling chips.

6. A chip bin according to claim 1, comprising a temperature sensor in said lower part of said chip bin arranged to monitor the temperature of chips and to regulate the supply of steam to said upper part of said chip bin in order to regulate said temperature.

7. A chip bin according to claim 1, further comprising a source of cooking liquor arranged to supply said cooking liquor into said lower part of said chip bin.

8. A chip bin having an upper part through which chips are arranged to fall freely from an inlet;

a lower part within which chips are ranged to remain until they are removed by a feeding device downstream;

a level sensor arranged to detect a level of said chips between said upper part and said lower part; and steam orifices above said level sensor arranged to strike chips falling from said inlet with steam;

further comprising at least one conical baffle projecting from a wall of said bin above said level sensor, steam orifices disposed below said at least one baffle and above said level sensor and arranged to direct steam at chips falling past said baffle, and an exhaust pipe opening out of a space under said at least one baffle.

9. Apparatus for digesting wood chips to produce pulp, comprising:

a digester; and a chip bin having a lower part within which chips are arranged to remain until they are transferred to said digester, the chip bin having an upper part through which chips are arranged to fall freely from an inlet to said lower part, a level sensor arranged to detect a level of chips in the bin, and steam orifices arranged above said level sensor to strike chips falling from said inlet with steam.

10. Apparatus according to claim 9, wherein said chip bin comprises upwardly angled steam orifices arranged to direct steam upward at said chips and thereby to delay the falling of the chips.

11. Apparatus according to claim 10, wherein said chip bin comprises steam orifices angled tangentially.

12. Apparatus according to claim 9, wherein said chip bin further comprises at least one conical baffle projecting from a wall of said bin to guide the falling chips away from the wall of the bin, and steam orifices disposed below said at least one baffle and arranged to direct steam at chips falling past said baffle in said upper part of said chip bin.

13. Apparatus according to claim 12, wherein said chip bin further comprises an exhaust pipe arranged to extract gases from a space under said at least one baffle.

14. Apparatus according to claim 9, wherein said chip bin comprises at least two treatment zones in said upper part of said chip bin through which said chips fall successively, each with steam orifices arranged to direct steam onto said falling chips.

15. Apparatus according to claim 9, wherein said chip bin further comprises a temperature sensor arranged in said lower part of said chip bin to monitor the temperature of chips and to regulate the supply of steam to said upper part of said chip bin in order to regulate said temperature.

16. Apparatus according to claim 9, further comprising a source of cooking liquor for said digester, wherein said source is arranged to supply said cooking liquor into said lower part of said chip bin.

17. Apparatus for digesting wood chips to produce pulp, comprising:

a digester; and a chip bin having a lower part within which chips are arranged to remain until they are transferred to said digester,said chip bin having an upper part through which chips are arranged to fall freely from an inlet to said lower part, and including:

steam orifices arranged to supply steam to said upper part of said chip bin;

a temperature sensor below said steam orifices to monitor the temperature of chips; and a control unit responsive to said temperature sensor to regulate the supply of steam to said upper part of said chip bin in order to regulate said temperature.

* * * * *